US005839132A

United States Patent [19]

Rooney

[11] Patent Number: 5,839,132

[45] Date of Patent: Nov. 24, 1998

[54] INFLATABLE BATHTUB LINER

[76] Inventor: Todd D. Rooney, 2103 Shady Lane Dr., Norwalk, Iowa 50211

[21] Appl. No.: 820,108

[22] Filed: Mar. 19, 1997

[51] Int. Cl.[6] ..... A47K 3/02

[52] U.S. Cl. ..... 4/583; 4/582

[58] Field of Search ..... 4/580, 581, 582, 4/583, 619, 654, 655, 657, 659

[56] References Cited

U.S. PATENT DOCUMENTS

| | | | |
|---|---|---|---|
| 3,892,000 | 7/1975 | Morse . | |
| 3,931,652 | 1/1976 | Navarra | 4/580 |
| 4,010,498 | 3/1977 | Jablonski . | |
| 4,051,563 | 10/1977 | Clarke, Jr. | 4/580 |
| 4,264,991 | 5/1981 | Lasalandra . | |
| 4,602,393 | 7/1986 | Fiveash . | |
| 4,630,323 | 12/1986 | Sage et al. . | |
| 4,956,882 | 9/1990 | Cohn, III . | |
| 4,970,733 | 11/1990 | Cocciadiferro et al. . | |
| 5,040,252 | 8/1991 | Taggart | 4/580 |
| 5,153,950 | 10/1992 | Sowers . | |
| 5,216,764 | 6/1993 | Hall et al. . | |

*Primary Examiner*—David J. Walczak
*Attorney, Agent, or Firm*—Zarley, McKee, Thomte, Voorhees & Sease

[57] ABSTRACT

An improved disposable bathtub liner includes inflatable sub-compartments which detachably adhere to the interior surface of a bathtub through suction devices on the exterior surface of the liner. The bathtub liner includes opposite sidewalls, endwalls, and at least a partial bottom, and is made of a material which is durable, economical and disposable, while at the same time provides frictional engagement with a person, and which can be detachably sealed to the interior of the interior surface of the bathtub.

3 Claims, 2 Drawing Sheets

INFLATABLE BATHTUB LINER

BACKGROUND OF THE INVENTION

A. Field of the Invention

The present invention relates to bathtubs generally and more particularly to an improved liner for a bathtub.

B. Problems in the Art

Bathtub liners have been known for some time. Generally, such liners are designed to provide comfort, as well as safety. U.S. Pat. Nos. 2,264,672 and 2,495,602 both disclose cushion-type linings for bathtubs. U.S. Pat. No. 579,532 in turn illustrates a bathtub mat which includes side portions that provide a cushioning effect.

Bathtubs have hard surfaces and become slippery when wet. The interior surfaces of the tubs acquire a layer of residue comprised of dirt, soap and water impurities which require repeated cleaning of the tubs. To prevent injury, liners have been used to provide better traction. In general, these liners involve floor mats affixed to the bathtub. Likewise, protective padding on the sides and bottom of the tub have been used to prevent injuries from accidental falls. Examples of these types of liners are shown by Fishman in U.S. Pat. No. 1,759,348 and Rinaldi U.S. Pat. No. 2,495,692. Fishman teaches a liner mat and attached cushion. The cushion provides comfort for a reclining tub user. The mat and cushion are affixed by numerous suction cups. Rinaldi teaches a protective liner which includes several pads which cover the sides, ends, and bottom of the tub. The pads have a non-slip surface and are made of sponge rubber.

U.S. Pat. No. 5,153,950 to Sowers sets forth a liner designed to be of a disposable nature. Sowers provides a flexible liner wherein a textured or roughened top surface provides a frictional engagement for an individual. However, securement of the liner is obtained through the use of clamping members.

This invention solves these and additional problems by providing a tub liner made of a disposable material, with a non-slip surface and inflatable cushion. The liner is firmly secured to the tub via suction devices and the surface of the liner is of a material which provides a frictional engagement with a person. The liner is inflatable to provide comfort and may be easily disposed of after use. The liner prevents contact of the tub surface by the water in the tub, thus keeping the tub surface clean.

Therefore, the principal object of this invention is to provide a tub liner that will keep the tub clean and which is economically disposable.

A further object of this invention is to provide a tub liner having a non-slip surface.

A further object of the invention is to provide a liner that is inflatable to provide comfort to the user and to protect against injuries from accidental falls.

A further object of the invention is to provide detachable support members positionable at various locations on the tub surface.

A further object of the invention is to provide a new and improved disposable bathtub liner which is of a durable and reliable construction.

These and other objects, features, and advantages of the present invention will become more apparent with reference to the accompanying specification and claims.

SUMMARY OF THE INVENTION

The invention is a bathtub liner comprised of opposite side walls, opposite end walls, and at least a partial bottom.

The shape of the liner conforms with the standard shape of a bathtub. The exterior portion of the liner contains suction devices which are attachable to the interior walls of the bathtub and are detachable when force is applied towards the interior wall of the bathtub. The liner is divided into sub-compartments which are inflatable and provide comfort, as well as protection from accidental falls. The surface of the liner is of a material which provides frictional engagement with a person.

The non-slip and inflatable design prevents injuries, as well as provides a safe comfortable way to enjoy bathtub bathing. The liner is likewise of an economical and durable material such that the liner may be disposed of after use. Consistent use of the liner will reduce the need to scrub and clean the bathtub allowing one to save money on cleaning products. The liner is also designed to support the weight of an adult entering or exiting the tub and the suction devices are of sufficient strength to remain intact when subjected to the weight.

DESCRIPTION OF THE PREFERRED EMBODIMENT

With reference to the drawings, a new disposable bathtub liner 10 embodying the principals and concepts of the present invention will be described.

Figure 1:
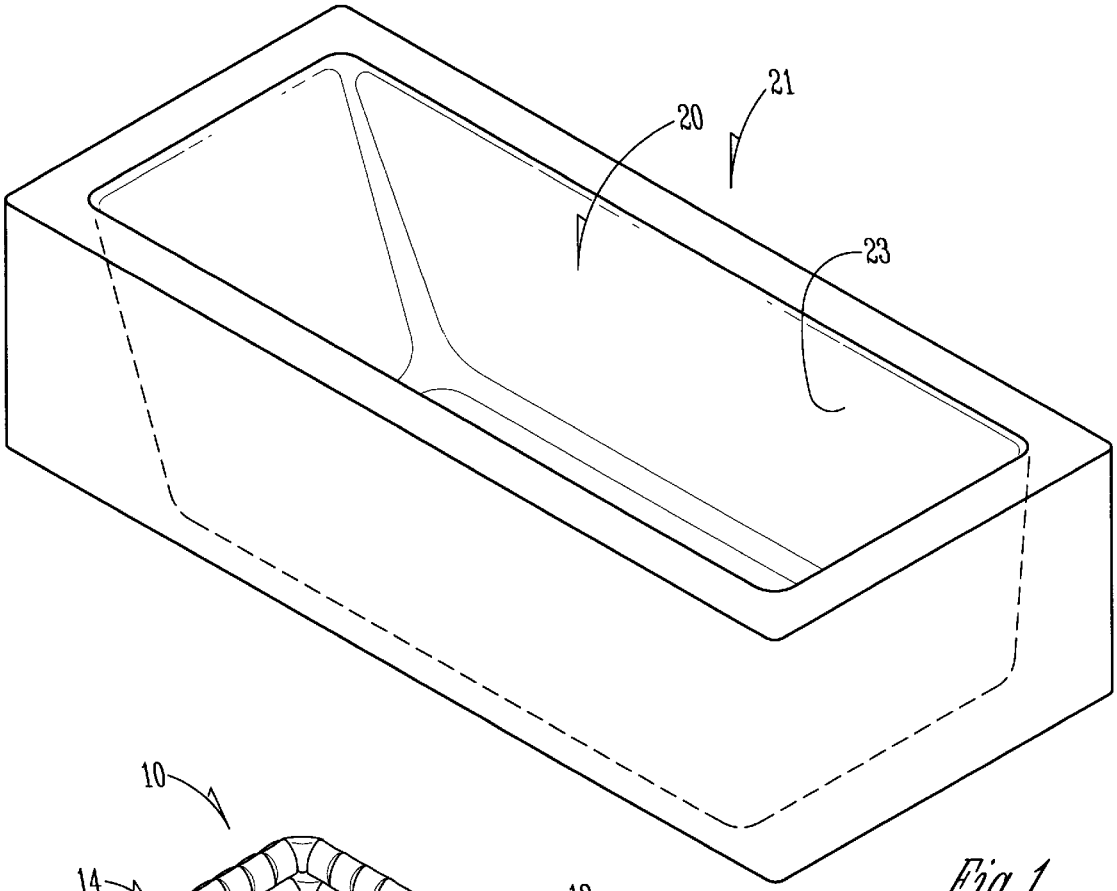
FIG. 1 is a perspective view of a bathing compartment.
Figure 2:
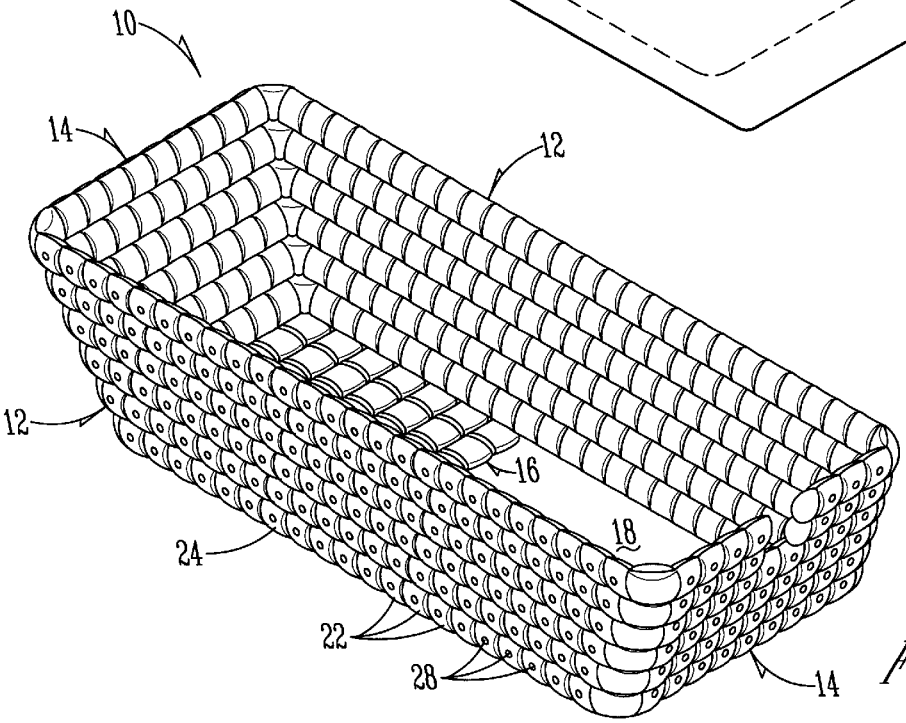
FIG. 2 is a perspective view of the bathtub liner.

The disposable bathtub liner 10 (FIG. 2) is comprised essentially of opposite sidewalls 12, opposite endwalls 14, a bottom 16, and a closeable drain opening 18. The liner 10 is shaped to conform to a bathing compartment 20 of conventional bathtub 21. The liner 10 has air inflatable compartments 22 such that when inflated the liner 10 will engage with the interior surface 23 of the bathing compartment 20.

Figure 3:
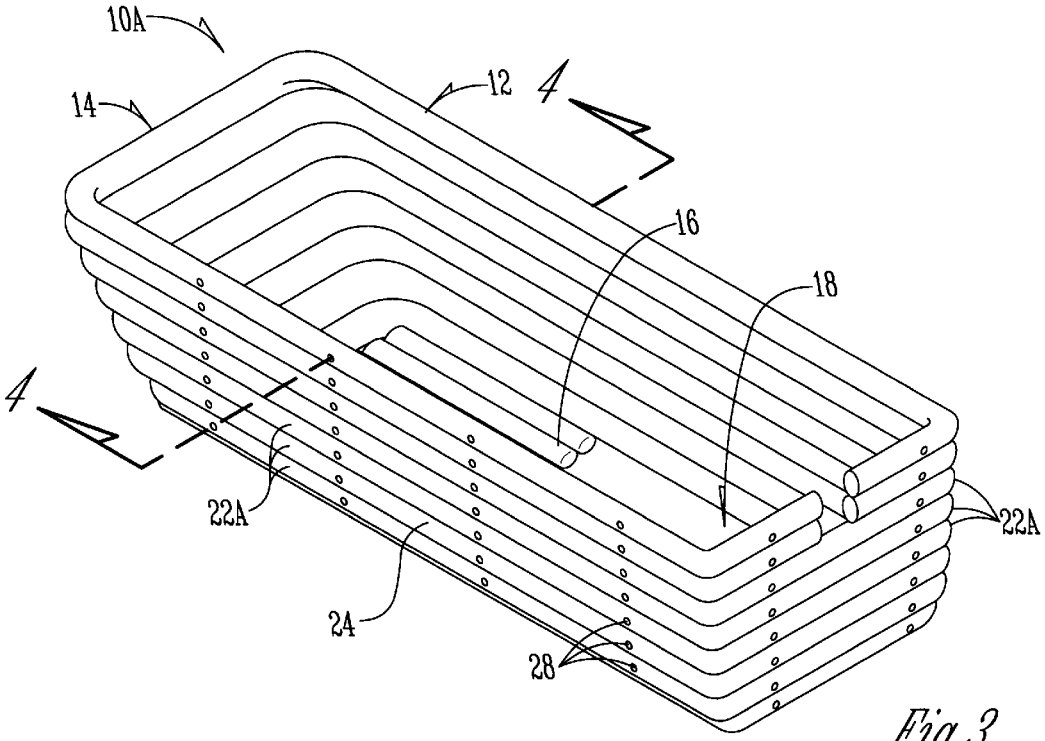
FIG. 3 is a perspective view of an alternate bathtub liner where inflatable sub-compartments are shaped in rod-like hemispheres.
Figure 4:
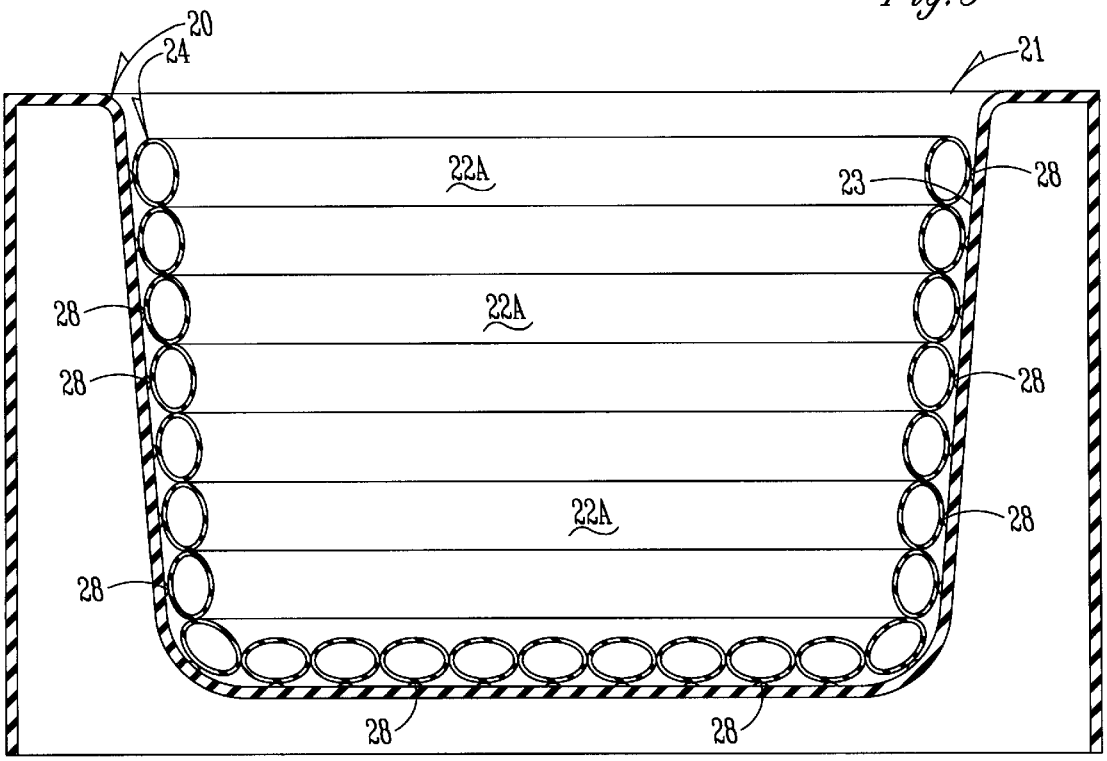
FIG. 4 is an end view of the liner as it engages with the interior walls of the bathing compartment.

On the exterior surface 24 of the liner 10 are a plurality of conventional suction elements 28 which engage the interior surface 23 of the bathing compartment 20. As previously identified, the liner 10 is comprised of a plurality of inflatable sub-compartments 22. The alternate form of the invention (FIG. 3) shows elongated horizontal sub-compartments 22A in liner 10A.

The liners 10 and 10A can be inflated by mouth through a conventional orifice (not shown) typical of inflatable sleeping mattresses or the like. The compartments of each of the liners 10 and 10A are in communication with each other so that all compartments can be inflated from a single closable orifice. The liner when inflated will have resilient thickness and the surface is of a material which provides a frictional engagement with a person. The material is also of an economical, durable, and disposable nature such as polypropylene. In use, the liner 10 or 10A are placed in the tub 21 and inflated. By applying pressure on the interior of the liners in a direction towards the interior surface 23 of the tub by elements 28, the liner can be fixedly attached to the tub. After a predetermined length of time of use, the liner can be pulled away from the surface 23, disposed of and replaced with a new liner.

It is therefore seen that this invention will at least achieve its stated objectives.

What is claimed is:

1. A liner for bathtubs having a bathing compartment, said compartment having opposite sidewalls, opposite endwalls, a bottom, and a closeable drain opening in said bottom, comprising:

a thin liner shaped to conform to a bathing compartment of a bathtub with said liner including opposite sidewalls, opposite endwalls, and at least a partial bottom, said liner being inflatable so that bathtub liner will have a resilient thickness when inflated wherein the exterior surface will generally engage the interior surface of the bathing compartment of a bathtub, and a plurality of suction elements contained on the exterior of said liner which engage with the interior of the bathing compartment of said bathtub.

2. The combination of claim 1 wherein liner is comprised of a plurality of inflatable sub-compartments, in air communication with each other.

3. The combination of claim 1 wherein the surface of the liner is of a material which provides a frictional engagement with a person.

* * * * *